United States Patent [19]

Parker et al.

[11] Patent Number: 4,905,814

[45] Date of Patent: Mar. 6, 1990

[54] COIL CONFIGURATION FOR ELECTRONIC COIN TESTER AND METHOD OF MAKING

[75] Inventors: Donald Parker; Robert Rollins, both of Elmhurst, Ill.

[73] Assignee: Coin Mechanisms, Inc., Elmhurst, Ill.

[21] Appl. No.: 232,924

[22] Filed: Aug. 16, 1988

[51] Int. Cl.[4] ..... G07D 5/08; H01F 5/02; H01F 41/08

[52] U.S. Cl. ..... 194/318; 29/605; 242/7.03

[58] Field of Search ..... 194/317, 318, 319; 324/234, 236, 239; 29/605; 242/7.03

[56] References Cited

U.S. PATENT DOCUMENTS

| | | | |
|---|---|---|---|
| 3,555,477 | 1/1971 | Hildebrandt | 29/605 X |
| 3,901,368 | 8/1975 | Klinger . | |
| 4,086,527 | 4/1978 | Cadot | 194/318 X |
| 4,108,296 | 8/1978 | Hayashi et al. | 194/318 |
| 4,251,911 | 2/1981 | Reynolds et al. | 29/605 |
| 4,437,558 | 3/1984 | Nicholson et al. . | |
| 4,469,213 | 9/1984 | Nicholson et al. . | |
| 4,574,936 | 3/1986 | Klinger . | |
| 4,734,974 | 4/1988 | Duve | 29/605 |
| 4,755,784 | 7/1988 | Taoka et al. | 29/605 X |

FOREIGN PATENT DOCUMENTS

| | | | |
|---|---|---|---|
| 2715403 | 10/1977 | Fed. Rep. of Germany | 194/318 |
| 2916123 | 10/1980 | Fed. Rep. of Germany | 194/319 |

*Primary Examiner*—F. J. Bartuska
*Attorney, Agent, or Firm*—Leydig, Voit & Mayer

[57] ABSTRACT

A coil used in electronic coin testers for testing a coin for the purpose of accepting a valid coin or rejecting a counterfeit coin in a coin-operated vending machine, game, telephone or the like is disclosed. A coin slot is provided having two opposing longitudinal walls spaced to accommodate a coin therebetween of either the sample coin type or the test coin type. Within each longitudinal wall a planar looped coil is provided that, upon inducement of an electric current, generates lines of magnetic flux which are normal to the opposing surfaces of the longitudinal walls throughout the length of the longitudinal walls.

3 Claims, 2 Drawing Sheets

COIL CONFIGURATION FOR ELECTRONIC COIN TESTER AND METHOD OF MAKING

BACKGROUND OF THE INVENTION

1. Field of the Invention

The present invention relates generally to coil design and is more particularly directed to coils used in electronic coin testers for testing a coin for the purpose of accepting a valid coin or rejecting a counterfeit coin in a coin-operated vending machine, game, telephone or the like.

2. State of the Prior Art

There are many kinds of coin operated devices and many ways to attempt to cheat them. Slugs, foreign coins and the retrievable coin-on-a-string are just a few examples. Therefore, there exist many coin testing devices that attempt to discriminate between acceptable coins and those that are not acceptable.

The art is crowded with numerous electromechanical coin testing devices that perform to a greater or lesser degree of accuracy and sensitivity. Among these are U.S. Pat Nos. 3,599,771, 3,741,363 and 4,469,213 which employ a pair of magnetic fields, each field present in a coin slot. In one slot, a sample coin is placed and in the other, a coin to be tested is made to pass through, often by the operator of the machine. Electronic circuitry monitors the magnetic fields in each slot to determine if the tested coin matches the sample coin using attenuation characteristics of the magnetic fields due to the sample and test coins as criteria. The narrower the attenuation detection band can be, i.e., how similar the test coin and sample coin attenuation characteristics need be before the coins match, the more sensitive and accurate the device becomes.

The coils used to generate the magnetic fields in the more sensitive prior art devices have been spiral coils having the outside periphery approximately equal to the diameter of the test and sample coins. Sometimes there have been, in one set, two or more coils in coaxial relation and sometimes they have been separated by circuit boards. The coils described generate flux patterns generally doughnut shaped with lines of magnetic flux cutting across the sample or test coin at the center and periphery of the coin. The coin's attenuation characteristics will, therefore, vary according to the coin's longitudinal attitude or physical position in relation to the coil. If the coin is even slightly off center, approximately half of the magnetic field will be left unaffected. This, in turn, creates inaccuracies in the device. Additionally, a separate set of test and sample coin slots must be used for each type of coin (i.e. nickel, dime, quarter, etc.) each having the outer periphery of the spiral coil to fit the size of the coin that the device is designed to detect. The following invention does not have these limitations.

SUMMARY OF THE INVENTION

It is a primary object of the present invention to provide a new and improved coil design to be used in existing electro-magnetic coin detecting apparatuses.

It is a further object of the present invention to provide a coil design generating a magnetic flux pattern normal to the face of a coin throughout the coin's diameter regardless of the coin's longitudinal position within the slot.

It is a related and more specific object of the present invention to provide a coil design generating such a magnetic flux pattern constant throughout the slot's longitudinal axis.

It is a further object of the present invention to provide a coil design that can be manufactured easily and economically.

The present invention provides a new and inventive coil design for use with existing coin comparing technology as well as new technology useful in handling multiple varieties of coins. In accordance with the preferred embodiment of this invention, a coil design is disclosed which generates a unique flux pattern. This flux pattern is generated in such a way as to cut through a coin, situated in a coin slot, normal to the face of the coin throughout a diameter of the coin.

Further in accordance with the preferred embodiment, the coil generated flux pattern remains constant throughout the coin slot. This means that the magnetic coupling of the coils will remain unchanged as the coin's longitudinal attitude or physical position in the coil or magnetic field varies. The result is a superior coin detecting apparatus with regard to sensitivity and accuracy.

BRIEF DESCRIPTION OF THE DRAWINGS

Other objects and advantages will become apparent with reference to the following description when taken in conjunction with the drawings in which.

DESCRIPTION OF THE PREFERRED EMBODIMENT

While the invention will be described in connection with a preferred embodiment, there is no intent to limit it to that embodiment. On the contrary, the intent is to cover all alternatives, modifications and equivalents included within the spirit and scope of the invention as defined by the appended claims.

In accordance with the present invention, a coin slot is provided having two opposing longitudinal walls spaced to accommodate a coin therebetween of either the sample coin type or the test coin type. Within each longitudinal wall a planar looped coil is provided that, upon inducement of an electric current, generates lines of magnetic flux which are normal to the opposing surfaces of the longitudinal walls throughout the length of the longitudinal walls.

Figure 1:
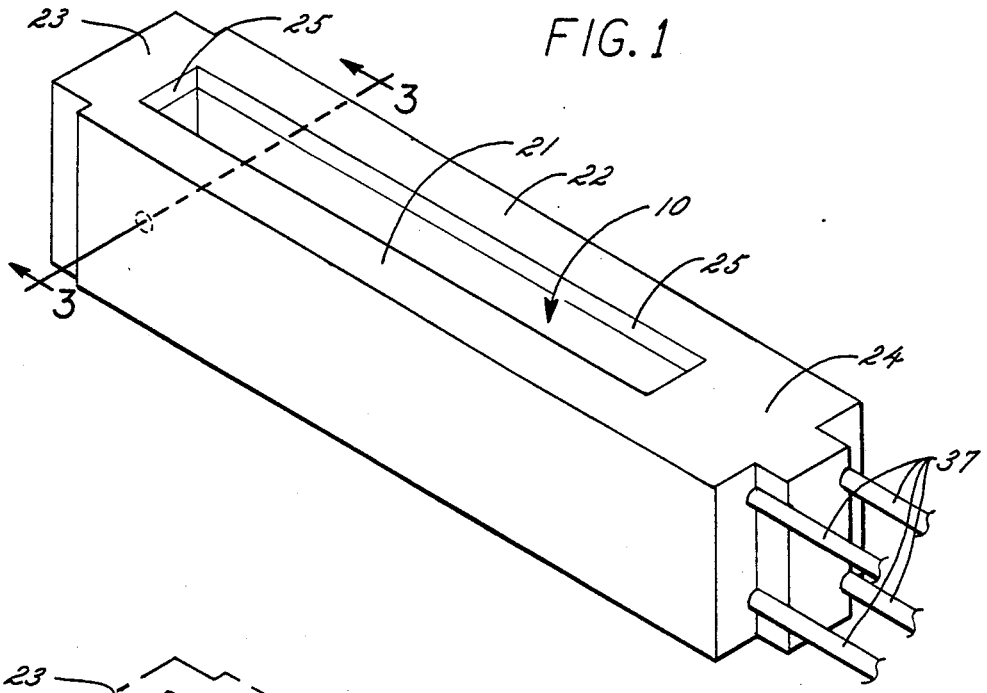
FIG. 1 is a plan view of the coin slot according to the invention.
Figure 2:
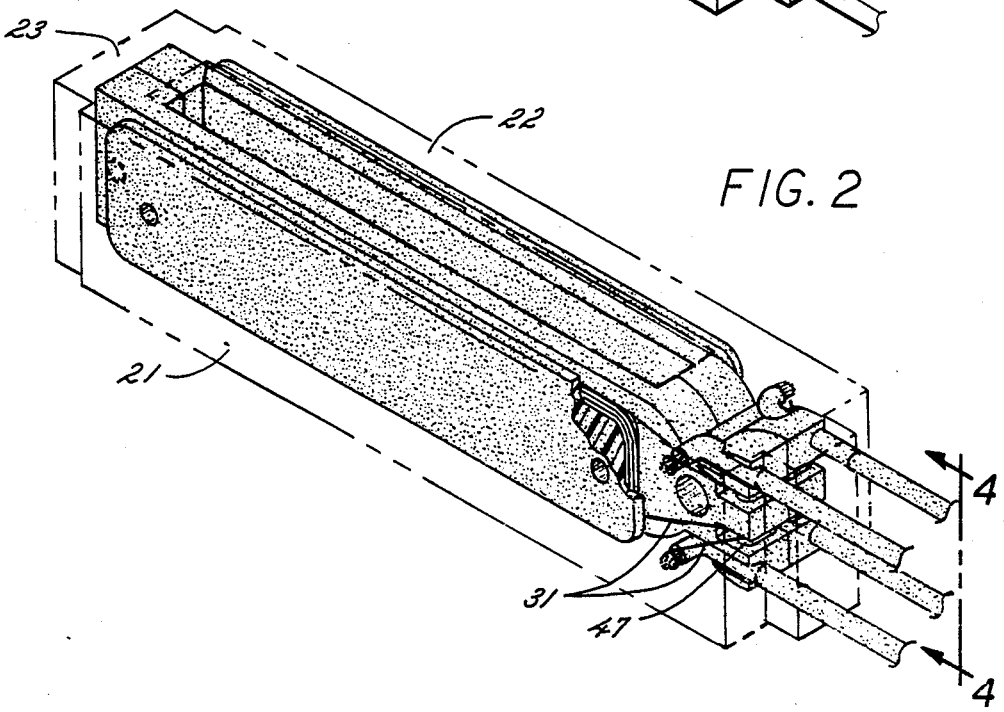
FIG. 2 is a partial cut away view of the device of FIG. 1.
Figure 3:
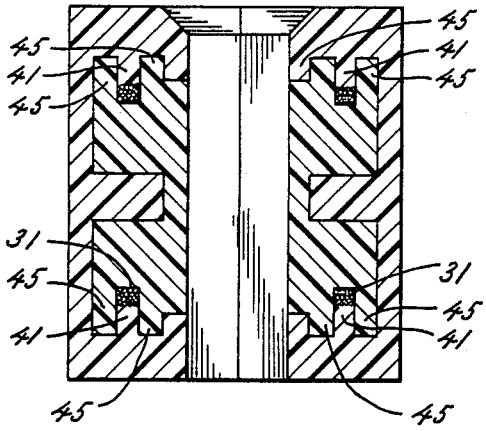
FIG. 3 is a cross sectional view of the device taken along line 3—3 of FIG. 1.
Figure 4:
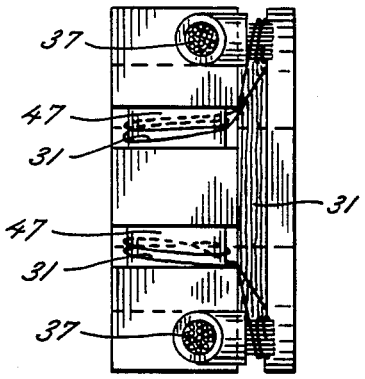
FIG. 4 is a view taken along line 4—4 of FIG. 2 showing the wire wound about the support posts.

In keeping with the invention, longitudinal walls 21, 22, as shown in FIG. 1, run the length of the slot 10. In order to accommodate a coin, either to be tested or to be used as a sample, longitudinal walls 21, 22 are spaced slightly wider than the width of the widest coin expected to pass through the slot. Opposing side walls 23, 24 are provided to maintain the desired spacing between longitudinal walls 21, 22.

In order to aid in guiding the coin between longitudinal walls 21, 22, and side walls 23, 24, each wall is provided with angled portion 25 flaring from the inside surfaces of each wall outwardly. Angled portion 25 allows the user of the coin operated device to be less than exact in his placement of the coin through the slot.

In keeping with another important aspect of the invention, each longitudinal wall 21, 22 has disposed within, a wire 31 of the standard type to be wound about itself and generate a magnetic field without short circuiting or cutting off the flow of electricity through the wire 31. In order to generate lines of magnetic flux normal to the surface of longitudinal walls 21, 22, wire 31 is generally disposed planarly parallel to longitudinal walls 21, 22.

Figure 5:
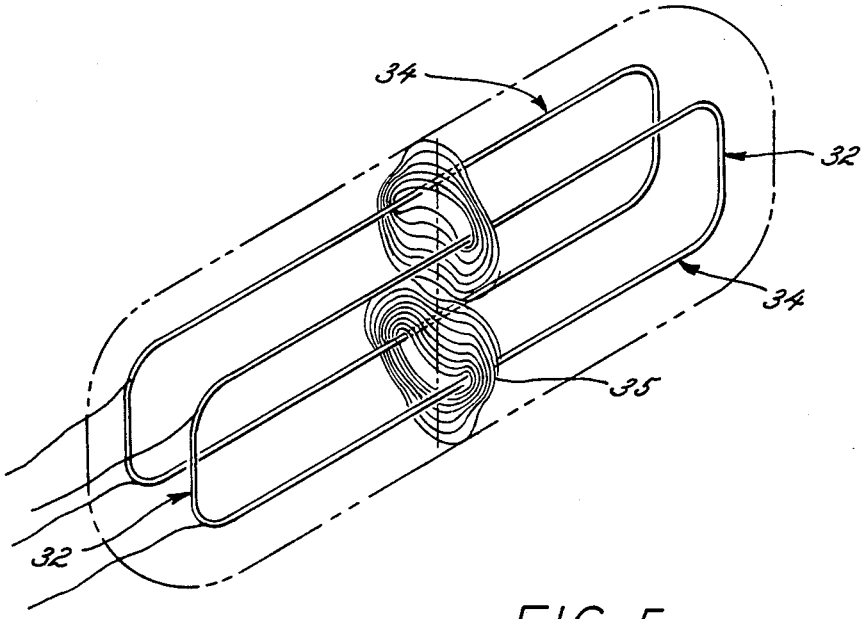
FIG. 5 is a cross sectional illustration of the flux pattern of the coil according to the invention.

In keeping with the invention, wire 31 is wound in a loop about itself leaving a central gap in order to generate magnetic flux lines that are not only normal to longitudinal walls 21, 22 but are also present at substantially all points along the longitudinal walls 21, 22. In order to aid in the coiling process, channels 41 are provided between posts 45 within walls 21, 22. Channels 41 further confine wire 31 to a loop shape, i.e., wound in a coil about itself having a central gap, in order to generate the above described magnetic flux lines. As best illustrated in FIG. 5, magnetic flux lines are depicted by lines 35, of which only those at a cross section of the slot are shown. Magnetic flux lines 35 are substantially horizontally uniform along the length of longitudinal walls 21, 22 so that the coin's longitudinal position within slot 10 may vary and still allow the supporting circuitry to detect a true coin and reject a counterfeit coin.

In keeping with the invention, wire 31 is attached to leads 37 in a conventional manner in order to make the transition between wire suitable for coiling and wire suitable for the supporting circuitry of the coin testing device.

In order to maintain the proper tension in wire 31 during the coiling process, upon transition from lead 37, wire 31 is drawn around support post 47. After wire 31 makes one or more revolutions about support post 47, the coiling process proceeds with a lessened chance of wire 31 disengaging from lead 37. After wire 31 has made one or more loops about channels 41, and in order to help maintain contact with lead 37, as well as maintain proper wire tension, wire 31 is wound one or more times about support post 47 before engaging lead 37.

In keeping with the invention, wire 31, about channels 41, is dimentioned so that side edges 32 extend beyond the inner faces of side walls 23, 24. This helps insure that the corners and sides 32 of the wire loop 31 avoid generating nonuniform magnetic flux lines within the slot 10.

In keeping with another important aspect of the invention, slot 10 is dimentioned to accept and test any size coin. For example, if the coin is large enough to just fit between side walls 23, 24 and wide enough to just fit between longitudinal walls 21, 22 with very little leeway, the coin can only exist in slot 10 in one particular position. If the coin is a true coin, the magnetic flux pattern generated by the looped coil will be altered the same way every time such a coin passes through slot 10. This may then be detected by supporting circuitry. Moreover, if the coin is a smaller coin, it may be situated in any position within the magnetic field, provided it is generally planarly parallel to the longitudinal wall. Because the flux pattern within slot 10 is longitudinally constant throughout the longitudinal walls 21, 22, the overall magnetic flux pattern will not change if the sample coin is at either end of the slot 10 or at any point between the two extremes. Similarly, if the coin is of the test type passing through the flux lines 35, it will not matter if the coin passes at either end or between. The magnetic coupling between the slot 10 will be altered the same every time a true coin is present. It can be seen therefore, that this coil design may be used for a slot that accepts and tests multiple coins.

One illustration of the above principle is to have a sample slot for each of a quarter, dime and nickel and one slot for the customer to pass a test coin through. The flux pattern altered by the test coin may be compared to each of the sample coin slots flux patterns. If any one matches, that amount is registered for further processing. If none match, the coin may be rejected.

In keeping with the invention, longitudinal walls 21, 22 and side walls 23, 24 are made of a suitable material to allow the magnetic flux lines to pass through and exist in a generally unaltered state within slot 10. In order to protect surrounding circuitry or other nearby coin slots, however, walls 21, 22, 23 and 24 are made of such a material to retard the magnetic field from existing outside of slot 10.

In keeping with the invention, it is noted that the strength of the magnetic field may be altered for various applications simply by increasing the current through wire 31 or by varying the number of times wire 31 is looped about itself. Additionally, current may be applied to leads 37 in such a way as to induce the magnetic field to add or cancel in slot 10 according to particular applications.

From the foregoing, it will be appreciated that an improved coil design for generating magnetic fields within coin slots for the purposes of testing a coin to determine it it is real or counterfeit has been described. In order to provide a magnetic field which may be altered by the coin without depending on the coin's physical longitudinal position within the coin slot, magnetic flux lines normal to the coin and longitudinally constant throughout the slot can be easily employed in existing coin comparing technology as well as multiple coin comparing.

We claim:

1. A method of manufacturing an apparatus for detecting coins in a vending machine or the like, said method comprising the steps of:

forming a base section having a slot communicating top and bottom sides of said base section, means for receiving conductive leads for transporting current, a plurality of insulating posts and at least two opposing and planar side walls of said slot for controlling the orientation of coins passing through said slot;

winding each of first and second wires to form coils which when energized create a magnetic field whose lines of flux through said slot are substantially perpendicular to said planar side walls everywhere in said slot and substantially uniform in density; said winding of each wire comprising the steps of:

securing said wire to a first one of said conductive leads;

wrapping said wire about a first one of said posts so as to relieve tension from the junction of the wire and the conductive leads during said winding;

coiling said wire to form a loop which lies in a plane parallel to said side walls;

wrapping said wire about a second one of said posts so as to relieve tension created in said wire during subsequent steps and preventing transfer of said tension to said loop; and securing said wire to a second one of said conductive leads.

2. A method as set forth in claim 1 including the step of encapsulating said loops.

3. An apparatus for detecting coins in a vending machine or the like, said apparatus comprising:

a base section having a slot communicating top and bottom sides of said base section;

means integral with said base section for receiving conductive leads for transporting current;

a plurality of insulating posts integral with said base section;

at least two opposing and planar side walls of said slot for controlling the orientation of coins passing through said slot;

a pair of wire coils and means for orienting said coils with respect to said slot such that when said windings are energized they create a magnetic field whose lines of flux through said slot are substantially perpendicular to said planar side walls everywhere in said slot and said magnetic field has a substantially uniform flux density along the entire length of said slot; and each of said coils including first and second ends which are each wrapped about one of said posts and one of said conductive leads.

* * * * *